United States Patent [19]

Klann

[11] Patent Number: 4,651,615

[45] Date of Patent: Mar. 24, 1987

[54] ELECTRIC VALVE FOR PIPE ORGANS

[76] Inventor: Paul A. Klann, 301 Fourth St., Waynesboro, Va. 22980

[21] Appl. No.: 759,803

[22] Filed: Jul. 29, 1985

[51] Int. Cl.[4] ..... G10B 3/06

[52] U.S. Cl. ..... 84/339; 84/60; 84/251

[58] Field of Search ..... 84/60–63, 84/88, 91, 333–339, 341–342, 368

[56] References Cited

U.S. PATENT DOCUMENTS

| | | | |
|---|---|---|---|
| 1,033,129 | 7/1912 | Turney | 84/60 |
| 1,255,090 | 1/1918 | Gally | 84/60 |
| 1,986,956 | 1/1935 | Brown et al. | 84/339 |
| 3,058,383 | 10/1962 | Durst et al. | 84/339 |

*Primary Examiner*—Lawrence R. Franklin
*Attorney, Agent, or Firm*—Sughrue, Mion, Zinn, Macpeak and Seas

[57] ABSTRACT

An electric valve for pipe organs is adapted to be mounted within an air chest and is provided with a valve member on an armature adapted to cooperate with a valve seat surrounding an air passage in the chest leading to a pipe. The valve member is comprised of a base member, a resilient member and a valve seat engaging member adhesively secured together with sufficient slack in the valve seat engaging member or the base member and air passages which permit direct contact of the pressurized air within the air chest with the valve seal engaging member to allow bounce of the armature while maintaining the valve seat engaging member in engagement with the valve seat. The armature extends through and is pivoted on a bracket by means of two ball bearings press fitted into sockets on opposite sides of the armature. The sides of the bracket are then pressed toward each other against the ball bearings which will then be pressed into the bracket to form complimentary sockets.

7 Claims, 16 Drawing Figures

FIG. 1
PRIOR ART
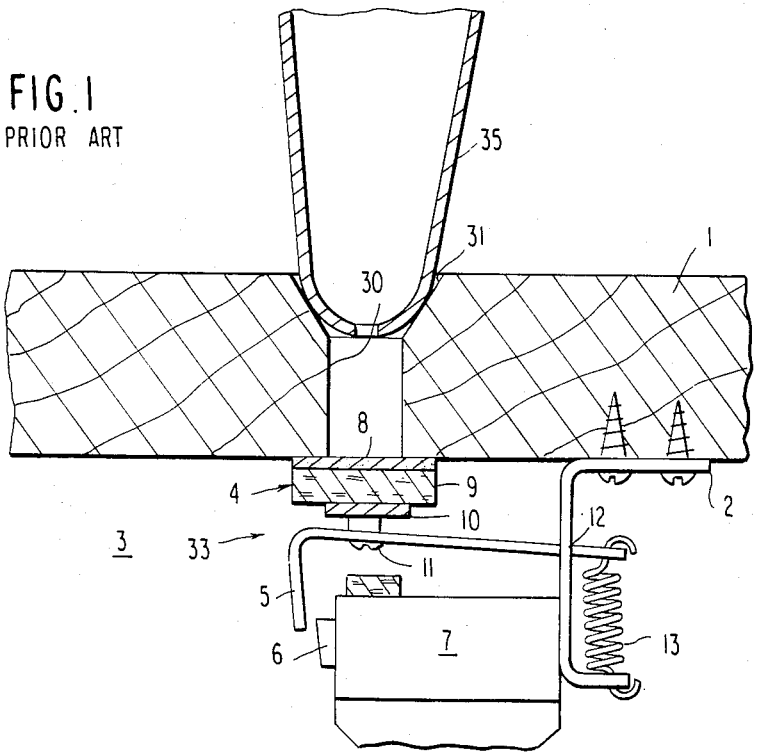
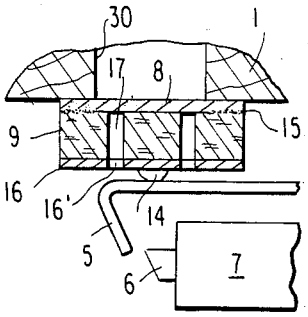
FIG. 2
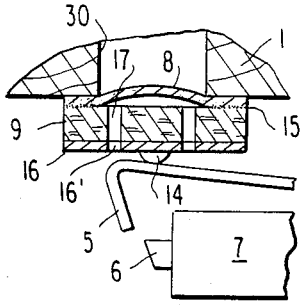
FIG. 3
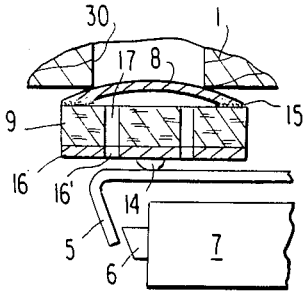
FIG. 4
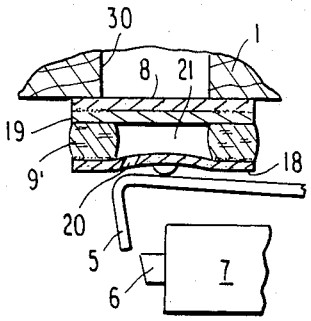
FIG. 5
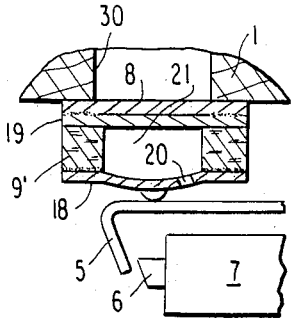
FIG. 6
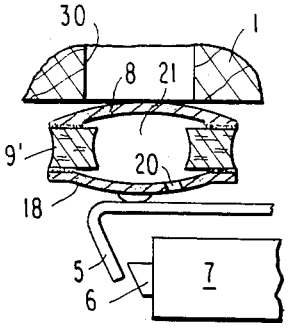
FIG. 7

FIG. 8
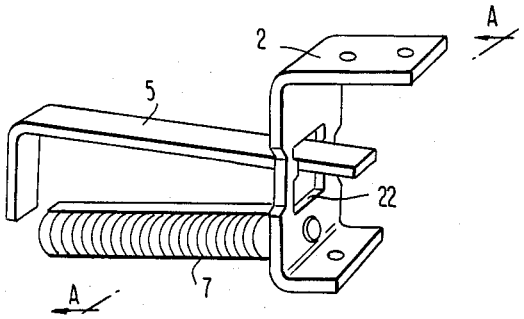
FIG. 9
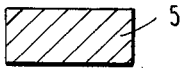
FIG. 10
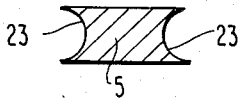
FIG. 11
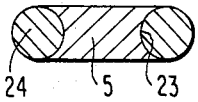
FIG. 12
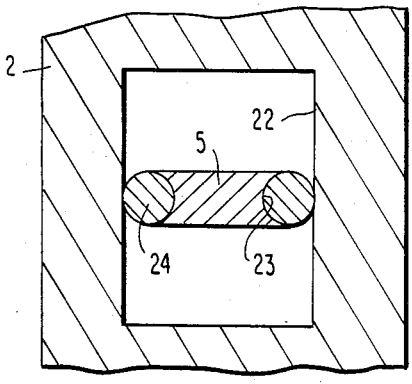
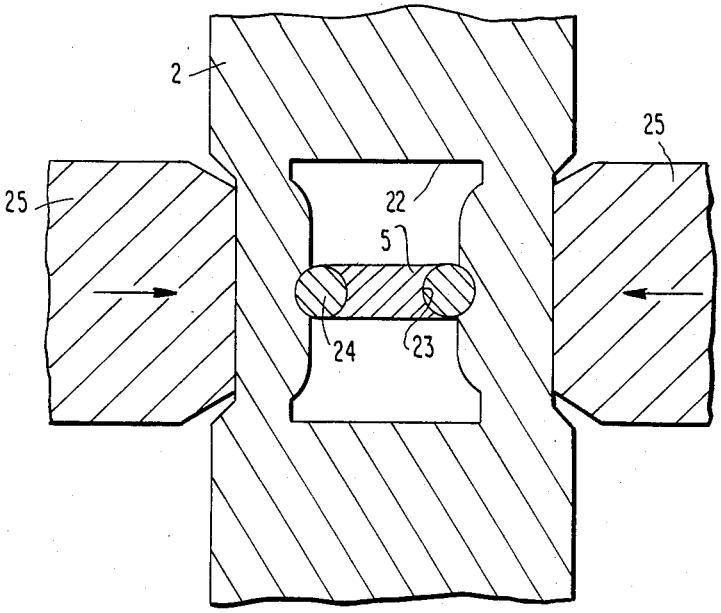
FIG. 13

ELECTRIC VALVE FOR PIPE ORGANS

BACKGROUND OF THE INVENTION

The present invention is directed to an electric valve for pipe organs and more specifically to an electric valve having an armature pivoted by means of ball bearings and a valve member secured thereto which is constructed in a manner to facilitate separation of the valve member from the valve seat and to eliminate undesirable bounce effects.

In designing valves for pipe organs the primary objectives are the reduction of noise in the operation of the valve, the elimination of bounce upon closing of the valve and a reduction in the force necessary to open a valve against the air pressure within the chest.

A conventional electric valve for pipe organs is illustrated in FIG. 1 of the present application wherein the top board 1 of a chest is provided with an air passage 30 having an enlarged beveled seat 31 surrounding the upper end thereof for receiving the foot of a pipe 35 The valve assembly 33 is mounted within the interior 3 of the chest which has not been shown in its entirety by means of a bracket 2. The interior 3 of the chest is maintained at a higher pressure than the atmospheric pressure outside of the chest and air is prevented from entering the foot of the pipe 35 by means of a valve member 4 which is secured to an armature 5. The armature 5 is pivotally mounted on the bracket 2 by means of a hinge pin 12. An electric coil 7 having a pole piece is mounted on the bracket 2 adjacent the armature 5 so that upon energization of the coil 7 the armature 5 will be pivoted counterclockwise as viewed in FIG. 1 to move the valve 4 away from the passage 30 to allow air under pressure to enter the pipe 35. A spring 13 is connected to one end of the armature 5 and the bracket 2 for biasing the armature in the clockwise direction to return the valve member into engagement with the valve seat surrounding the air passage 30 in the top board 1 upon deenergization of the coil 7. The valve 4 is comprised of a soft piece of leather cemented to a resilient material such as soft felt 9 which in turn is cemented to a metal disk 10 attached to the armature 5 by means of a rivet 11 or the like.

In the rest state, the pressure in the pipe is at atmospheric pressure in contrast to the positive increase in pressure within the chamber 3. Consequently the valve 4 is held by pressure against the seat to form a seal. To open the valve, a relatively large amount of power is required to break the seal but once the seal is broken the air pressure on both sides of the valve 4 approaches equality and as a result very little additional power is required to open the valve 4 to its maximum position. The pivoting of the armature 5 on the bracket 2 by means of the hinge pin 12 tends to create a considerable amount of noise due to clearances in the pivoting assembly.

The valve construction illustrated in FIG. 1 is also subject to an undesirable feature referred to as "bounce". As pointed out previously the deenergization of the coil 7 will cause the valve member 4 to move into engagement with the valve seat under the force of the spring 13. As the valve 4 closes the air rushing around the perimeter of the valve into the pipe causes an even greater increase in the velocity of the armature 5 moving toward the closed position. Once the valve 4 is closed, the armature 5 continues to travel due to the inertia of the armature and the resiliency of the felt 9.

Once the armature 5 has ceased movement, the potential energy stored within the felt 9 is released thereby causing the armature 5 to move in the opposite direction. Once again, within a short time frame, the velocity of the armature 5 increases to a degree where it has gained sufficient inertia to again open the valve 4. This process can be repeated several times, each time with the armature travelling a shorter distance till all movement ceases with the valve 4 in the closed position. This undesirable reopening of the valve due to bounce causes an undesirable speaking of the pipe 35.

SUMMARY OF THE INVENTION

The present invention provides a new and improved electric valve for pipe organs which eliminates all the above mentioned problems associated with conventional electric valves for pipe organs.

The present invention provides a new and improved electric valve for pipe organs utilizing ball bearings for pivoting the armature of the electric valve and having a new and improved valve member construction which eliminates the adverse effects of bounce while facilitating the opening of the valve by means of a relatively small force.

The present invention provides a new and improved electric valve for pipe organs comprising a chest having a top board with at least one aperture therethrough, an electric valve assembly mounted within the chest including bracket means having electric coil means thereon secured within said chest, an armature pivotally mounted on said bracket by means of ball bearings and a valve member mounted on said armature for movement into and out of engagement with a valve seat surrounding said aperture wherein said valve member is comprised of a support member secured to said armature, felt means secured to said support menber and a soft pliable sheet of material secured to one of said support members and felt members adjacent the periphery thereof with sufficient slack to allow separation of said soft pliable member from said felt member whereby the soft pliable member can be maintained in engagement with said valve seat during bouncing movement of said armature.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 1 is a sectional view showing a conventional electric valve for pipe organs mounted within a pipe organ chest.

FIGS. 2, 3 and 4 are partial sectional views similar to FIG. 1 showing a bounce sequence for a modified valve member according to a first embodiment of the present invention.

FIGS. 5, 6 and 7 are partial sectional views similar to FIG. 1 showing a bounce sequence for a modified valve member construction according to a second embodiment of the present invention.

FIG. 8 is a perspective view of the electric coil, bracket and armature assembly having a ball bearing pivoted connection between the armature and bracket according to the present invention.

FIGS. 9–13, inclusive, are partial sectional views taken line A—A in FIG. 8 showing the sequence of manufacturing operating for achieving the ball bearing pivot connection between the armature and bracket.

DETAILED DESCRIPTION OF THE INVENTION

Figure 14:
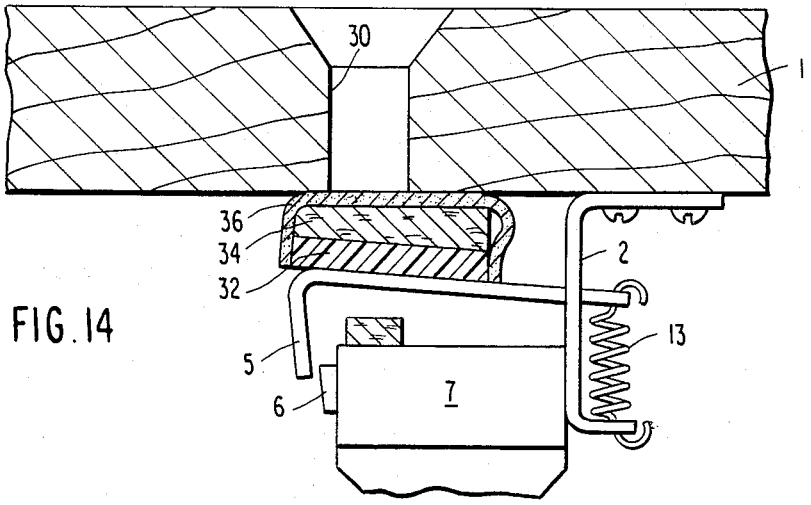
FIGS. 14 and 15 are partial sectional views similar to FIG. 1 showing a modified valve member construction according to a third embodiment of the present invention.

In order to overcome the problem associated with bounce the valve member according to the present invention may be constructed in several different ways each of which utilizes the same principle of the present invention. In the embodiment shown in FIGS. 2–4, inclusive, the valve member is provided with a soft pliable disk 8 of leather or the like which is secured adjacent the periphery thereof to a resilient disk 9 which may be of felt, a closed cell elastomer or the like. The leather disk 8 and the resilient disk 9 are cemented only around the perimeter as indicated at so that the central portion of the leather disk may separate from the resilient disk as shown in FIGS. 3 and 4. The resilient disk 9 is secured to a disk 16 which is comprised of a piece of metal having holes 16' which allows air to pass therethrough. The resilient disk 9 is also provided with plurality of air passages 17 so that air can freely pass to the space defined by the unsecured surfaces of the leather disk and the resilient disk. The disk 16 can be secured to the armature 5 by any suitable means such as a glob 14 of cement or elastomer.

Upon release of the armature 5 upon deenergization of the coil 7 the leather disk 8 will move into engagement with the valve seat surrounding the aperture 30 in the top of the chest as shown in FIG. 2. Due to the inertia of the armature 5 the armature will continue to move toward the top board 1 of the chest thus compressing the resilient disk 9 as shown in FIG. 3. The air at higher pressure within the chest 3 will pass through the apertured disk 16 and the passages 17 in the resilient disk 9 to cause the leather disk to bow upwardly into the passage 30. Upon release of the energy stored in the compressed resilient disk 9 the armature 5 and the disk 16 will still tend to bounce but in view of the fact that the valve disk 8 is only secured at its periphery to the resilient disk 9 and the presence of the higher air pressure on the center of the disk 8 the disk 8 will not separate from the valve seat. When the coil 7 is again energized the armature 5 will be attracted to the pole 6. However the coil does not have to exert enough power to initially break the air seal but need only have sufficient power to start and accelerate the movement of the armature 5 away from the top board while the leather disk 8 still maintains the seal. After the slack has been taken up in the leather disk 8, the seal will be broken, not only due to the power exerted by the coil 7 but to a greater degree by means of the kinetic energy generated by the inertia of the moving armature 5.

In the embodiment shown in FIGS. 5–7, inclusive, the rigid perforated disk 16 has been replaced by a soft flexible leather disk 18 having an aperture 20 extending therethrough and the resilient disk 9' is in the form of an annular ring defining a central chamber 21. Thus the bouncing movement of the armature 5 due to the resiliency of the ring 9' will be accommodated by the soft flexible leather disk 18 while the leather disk 8 is maintained in sealing engagement with the valve seat surrounding the air passage 30. The flexibility of the leather disk 18 also permits the armature 5 to generate kinetic energy to assist in the opening of the valve upon energization of the coil 7. In FIGS. 5 and 6 a rigid disk 19 has been secured between the leather disk 8 and the resilient felt ring 9' which enables a substantial reduction in noise upon engagement of the valve member with the valve seat surrounding the air passage 30. In FIG. 7 the rigid disk 19 has been eliminated so that the leather disk 8 will operate as in the previous embodiment discussed above with respect to FIGS. 3 and 4.

The coil and armature subassembly shown in FIG. 8 incorporates a unique ball bearing pivot arrangement between the armature 5 and a support bracket 2. The coil 7 is rigidly secured to the support bracket 2 by spot welding, riveting or any other suitable means.

FIGS. 9–13 are all sectional views taken along the line A—A in FIG. 8 showing the sequence involved in the construction of the ball bearing pivoted connection. The armature 5 is initially provided with a uniform rectangular cross section as shown in FIG. 9. A pair of opposed cavities 23 are formed in the sides of the armature 5. The cavities are formed by a controlled displacement of the metal while simultaneously being work hardened. As shown in FIG. 11 a pair of hardened steel balls 24 are then pressed into the sockets 23 and the armature is then located in the window 22 punched in the bracket 2 as shown in FIG. 12. A pair of work forming plungers 25 are then forced against the opposite sides of the bracket 2 in the vicinity of the window 22 to press the sides of the bracket inwardly against the hardened steel balls 24. Since the ball sockets in the armature 5 were previously work hardened, the hardened steel balls will be pressed into the softer metal of the bracket 2 as the plungers 25 move towards each other in the direction of the arrows. Once formed, the hardened ball bearings will be concealed within the respective sockets in the armature and the bracket so as to provide a free pivot connection between the armature and the bracket.

Figure 15:
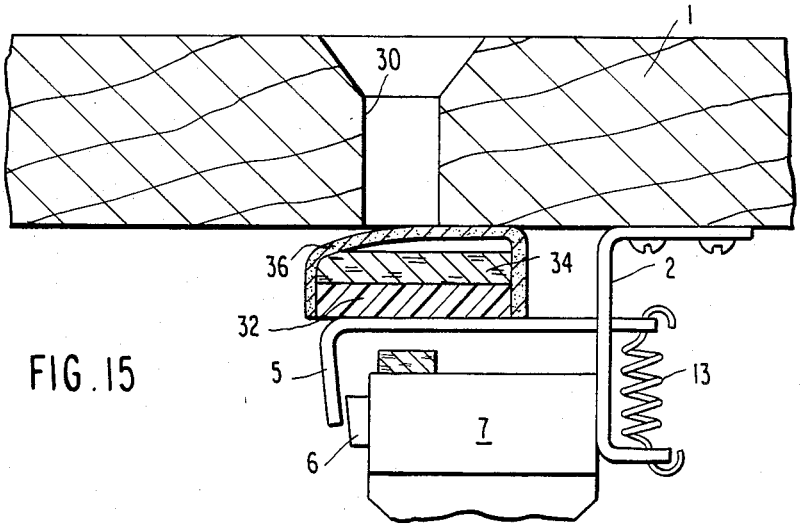
Figure 16:
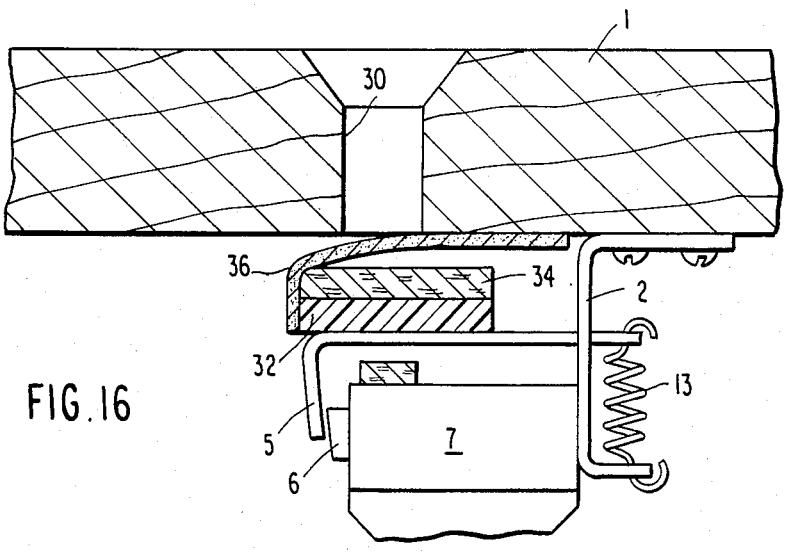
FIG. 16 is a partial sectional view similar to FIG. 1 showing a modified valve member construction according to a fourth embodiment of the invention.

Another variation in the construction of the valve member is shown in FIGS. 14–16. A rectangular piece of plastic 32 is secured to the armature 5 by any suitable means such as an adhesive or the like. A similarly shaped piece of felt 34 is secured to the plastic member 32 by an adhesive or the like and a flexible piece of material 36 of rubber, leather or the like is disposed in loose overlying relation with respect to the felt piece 34. The flexible member 36 is secured to opposite sides of the plastic piece 32 while leaving a considerable amount of slack in the portion overlying the felt piece 34 as shown in FIGS. 14 and 15. The flexible member is secured to the rectangular piece 32 by an adhesive or any other suitable means. The entire valve member comprised of the plastic piece 32, the felt 32 and the flexible piece 36 is positioned off center with respect to the air passage 30 in the top board 1 of the air chest. Thus upon energization of the coil 7 the armature and the valve member thereon will be moved from the closed position shown in FIG. 14 to the open position shown in FIG. 15. Due to the offset location of the valve member relative to the air passage and the excess slack in the flexible material overlying the felt piece the flexible piece 36 will be effectively peeled back away from the valve seat surrounding the air passage 30 so as to initially break the seal at one side of the air passage and gradually increase the opening. As a result of this gradual breaking of the seal a very small amount of power is required from the coil 7 in order to shift the armature 5 and the valve member thereon from the closed position to the open position. In FIG. 16 the flexible valve piece 36 is only secured along one edge of the plastic member 32 with the opposite end of the flexible piece 36 being secured to the undersurface of the top board 1 of the air chest. The same advantages accrue to this arrangement as discussed above with respect to the arrangement shown in FIGS. 14 and 15.

While the invention has been particularly shown and described with reference to proposed embodiments thereof it will be understood by those in the art that the foregoing and other changes in form and detail can be made therein without departing from the scope and spirit of the invention.

What is claimed is:

1. An electric valve for pipe organs comprising a bracket adapted to be mounted within an air chest of an organ, a coil fixedly mounted on said bracket and an armature having a valve member thereon pivotally mounted on said bracket and resilient means connected between said bracket and said armature for normally biasing said valve member in the closing direction, said valve member being comprised of a base member secured to said armature, a resilient member connected to said base member and a valve seat engaging member secured to one of said base and resilient members with at least one of said valve engaging member and base member being flexible and at least partially unsecured relative to said resilient member to compensate for armature bouncing while maintaining said valve engaging member in sealing engagement with a valve seat on said chest.

2. An electric valve as set forth in claim 1 wherein said base member and said resilient member are provided with a plurality of air passages extending therethrough and said valve seat engaging member is secured to said resilient member only adjacent the periphery thereof.

3. An electric valve as set forth in claim 2 wherein said base member is a rigid disk and said valve seat engaging member is a flexible member.

4. An electric valve as set forth in claim 2 wherein said valve seat engaging member and said base member are both flexible members secured to said resilient member only adjacent the outer periphery thereof.

5. An electric valve as set forth in claim 2 wherein said base member is a flexible member secured to said resilient member only adjacent the outer periphery thereof and a rigid disk member is secured intermediate said valve seat engaging member and said resilient member.

6. An electric valve as set forth in claim 1 wherein said valve seat engaging member is secured to said base member at opposite sides of said base member with excess slack between said valve seat engaging member and said resilient member whereby upon mounting said valve seat engaging member in an offset manner relative to a valve seat on said chest said excess slack will permit the disengagement of the valve seat engaging member from a valve seat on said chest in a gradual manner.

7. An electric valve as set forth in claim 1 wherein said valve seat engaging member is secured at one end thereof to said base member and is adapted to be secured at the opposite end to the valve seat.

* * * * *